US006390515B1

(12) United States Patent
Huang

(10) Patent No.: US 6,390,515 B1
(45) **Date of Patent: *May 21, 2002**

(54) ANTI-THEFT LATCH

(76) Inventor: Mao-Lien Huang, No. 32, Lane 778, Hua Cheng Rd., Hsinchuang City, Taipei Hsien (TW)

( * ) Notice: Subject to any disclaimer, the term of this patent is extended or adjusted under 35 U.S.C. 154(b) by 38 days.

This patent is subject to a terminal disclaimer.

(21) Appl. No.: 09/604,168

(22) Filed: Jun. 27, 2000

(51) Int. Cl.[7] ..... E05C 1/12
(52) U.S. Cl. ..... 292/169.14; 292/337; 292/346
(58) Field of Search ..... 292/71, 169.14, 292/192, 346, DIG. 41, 337, 169.15

(56) References Cited

U.S. PATENT DOCUMENTS 1,514,528 A * 11/1924 Hurd ..... 292/169.14
1,706,486 A * 3/1929 Gasey ..... 292/163
2,107,299 A * 2/1938 Kilpatrick ..... 292/163
3,172,691 A * 3/1965 Russell ..... 292/163
4,255,953 A * 3/1981 Dietrich et al. ..... 70/107
4,561,684 A * 12/1985 Marotto ..... 292/150
4,653,784 A * 3/1987 Lee ..... 292/71
5,529,351 A * 6/1996 Donald ..... 292/254
5,794,991 A * 8/1998 Smallegan et al. ..... 292/169
5,816,629 A * 10/1998 Donald ..... 292/254
5,927,770 A * 7/1999 Huang ..... 292/169.14
6,007,115 A * 12/1999 Roth ..... 292/71
6,164,099 A * 12/2000 Sh ..... 70/134
6,327,881 B1 * 12/2001 Grundler ..... 70/107

* cited by examiner

*Primary Examiner*—Christopher P. Schwartz
*Assistant Examiner*—Benjamin A Pezzlo
(74) *Attorney, Agent, or Firm*—Rosenberg, Klein & Lee

(57) ABSTRACT

An anti-theft latch is proposed. The anti-theft latch has a movable stud having a driven means therein. A pin serves to connect the movable stud with the driven means. The driven means is pivotally installed with a static latch. A guide groove is formed on the static latch. The pin is matched with the guide groove. The guide groove of the static latch is formed with a buckling portion. When the movable stud is to be unlocked by an outer force, the pin will eject and buckle the buckling portion so that the static latch can not retract to the movable stud to achieve an effect of statically locking. An auxiliary spring is further installed for pushing the driven means to move forwards. Therefore, in a normal condition, the static latch will achieve an effect of statically locking. As a result, the thief has no possibility to unlock the movable stud to move inwards and therefore, a preferred anti-theft effect is achieved.

3 Claims, 9 Drawing Sheets

ANTI-THEFT LATCH

FIELD OF THE INVENTION

The present invention relates to an anti-theft latch, and especially to a latch structure with a preferred anti-theft effect.

BACKGROUND OF THE INVENTION

Generally, the movable stud of a latch structure in the prior art is appended with a static latch. However, often, the movable stud can be unlocked easily and is not an ideal structure in anti-theft.

The applicant of the present invention ever discloses a patent application, Taiwan Patent Publication No. 86219232 in the name of "anti-theft latch". By this prior art, as a force is applied to a movable stud, the movable stud will not retract to the casing for achieving a preferred anti-theft effect. However, in that structure, only after the movable stud is moved inwards (backwards) through a certain distance, the static latch come into a latching condition for achieve an effect of statically locking.

Therefore, there is an eager demand for a novel anti-theft latch which may improve the defects in the prior art design.

SUMMARY OF THE INVENTION

Accordingly, the primary object of the present invention is to provide an anti-theft latch. Driven means are installed in a movable stud. A first pin is matched with the movable stud and the sliding groove of the driven means. The static latch is connected to a static latch by a second pin. A guide groove is installed on the static latch. The first pin is matched with the guide groove. The guide groove of the static latch is protruded with a buckling portion. If the movable stud is moved by an outer force, the first pin will eject against the buckling portion in the guide groove of the static latch so that the static latch can not retract to the movable stud to achieve an effect of statically locking. An auxiliary spring is further installed for pushing the driven means to move forwards. Therefore, in a normal condition, the static latch will achieve an effect of statically locking. As a result, the thief has no possibility to move the movable stud inwards and therefore, a preferred anti-theft effect is achieved.

The various objects and advantages of the present invention will be more readily understood from the following detailed description when reading in conjunction with the appended drawing.

DETAILED DESCRIPTION OF THE PREFERRED EMBODIMENTS

Figure 1:
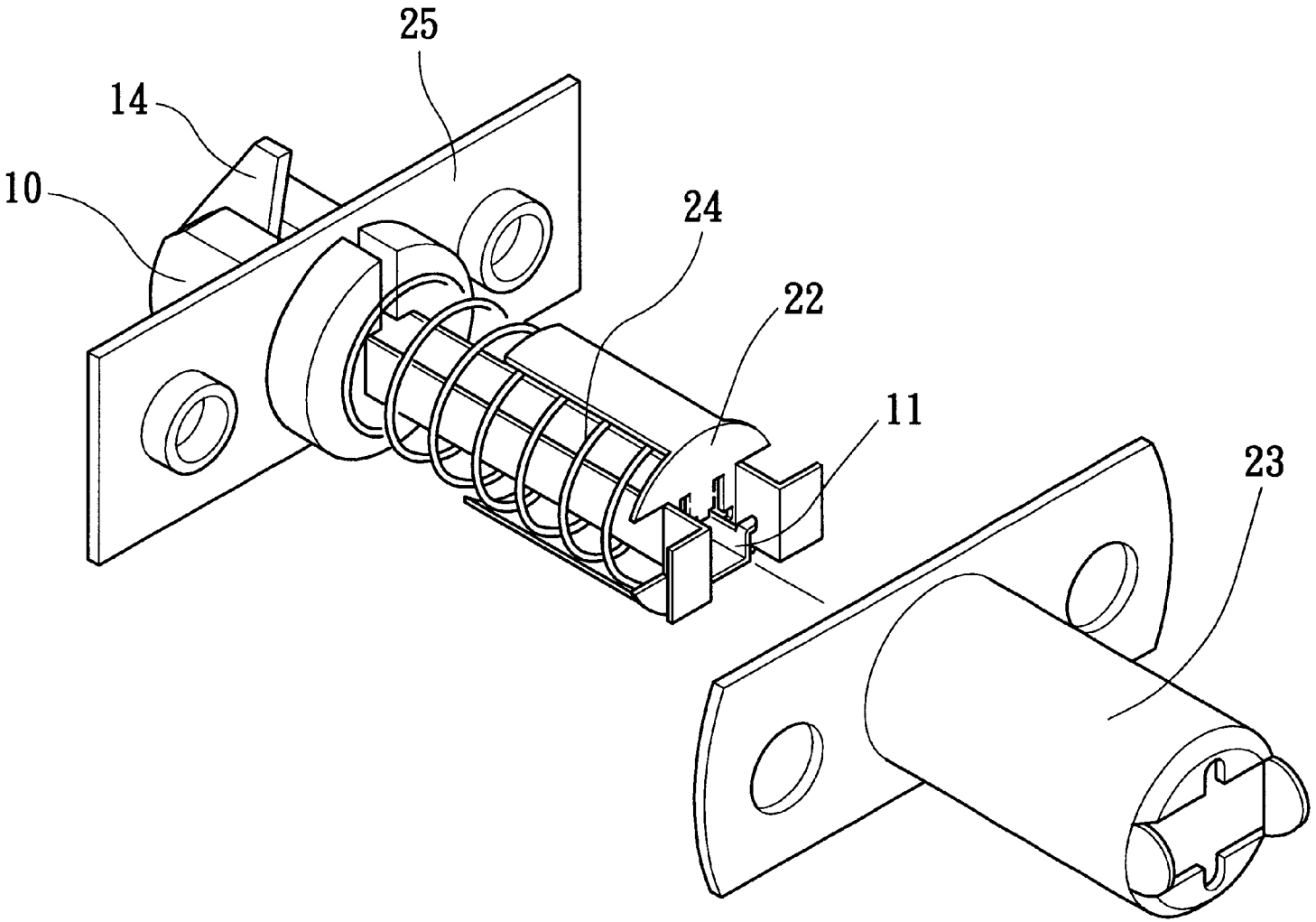
FIG. 1 is an assembled perspective view of the first embodiment in the present invention.
Figures 2, 2A, 2B:
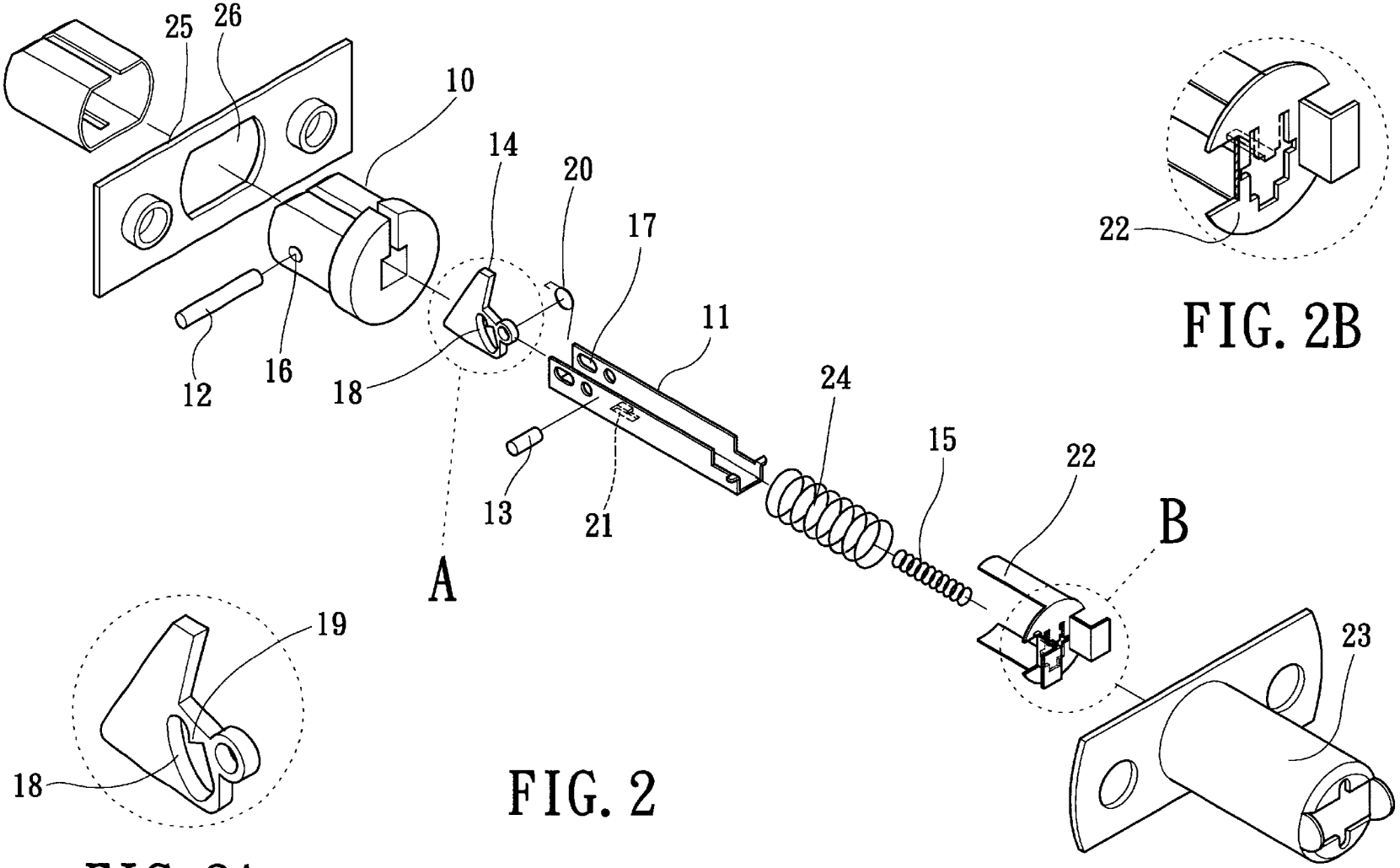
FIG. 2 is an exploded perspective view of the first embodiment in the present invention.
FIG. 2A is an enlarged detail of A in FIG. 2.
FIG. 2B is an enlarged detail of B in FIG. 2.
Figure 3:
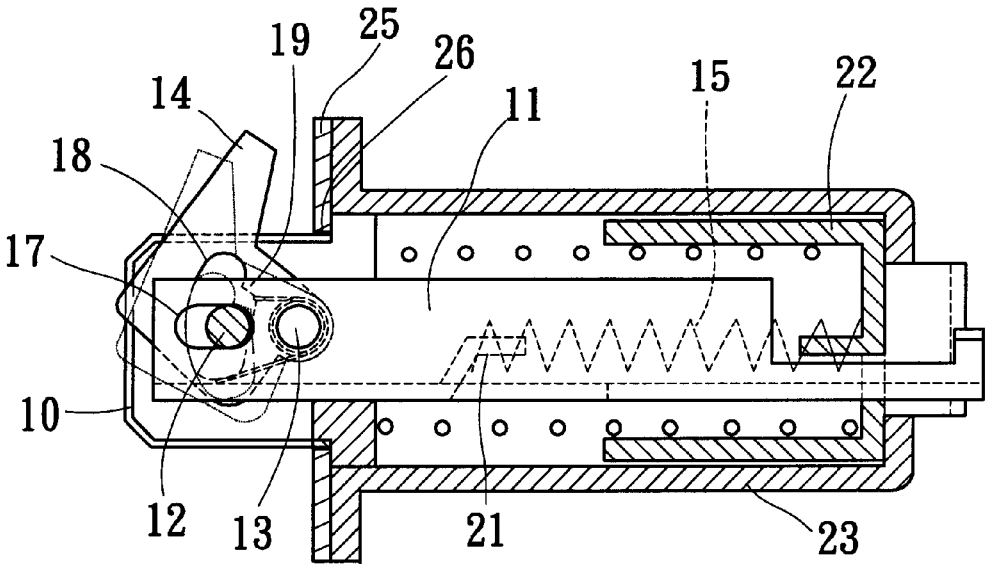
FIG. 3 is a plan cross sectional view of the first embodiment in the present invention.
Figure 4:
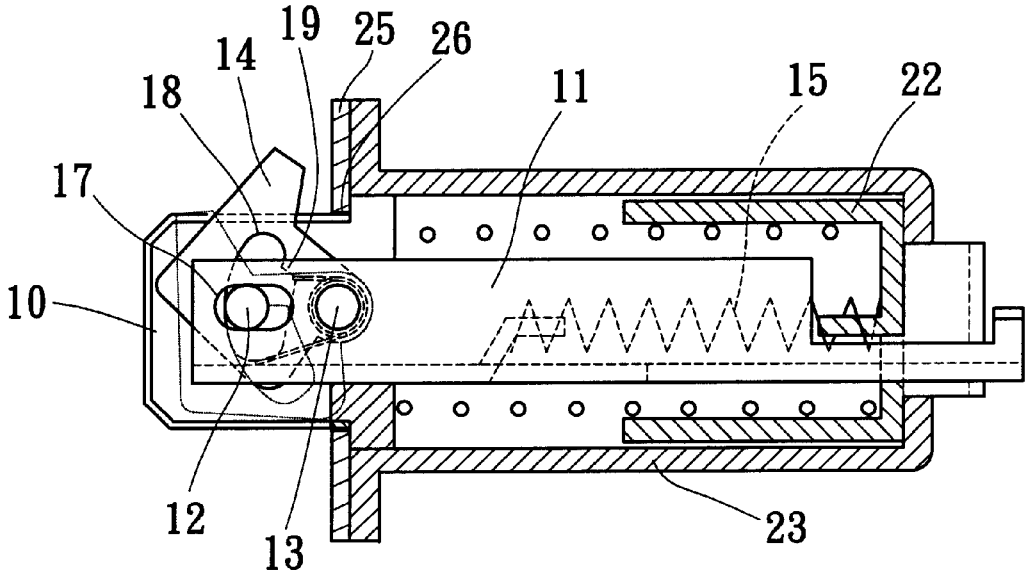
FIG. 4 is another plan cross sectional view of the first embodiment in the present invention.

With reference to FIGS. 1 to 4, the anti-theft latch according to the present invention is illustrated herein. The anti-theft latch of the present invention includes a movable stud 10, driven means 11, a first pin 12, a second pin 13, a static latch 14, an auxiliary spring 15 and other components. The driven means 11 which is slidable axially is installed within the movable stud 10. The driven means 11 can axially move forwards and backwards within the movable stud 10. The movable stud 10 radially penetrates through a pin hole 16. A horizontal sliding groove 17 is installed in the driven means 11. The first pin 12 is matched with the pin hole 16 of the movable stud 10 and the sliding groove 17 of the driven means 11 so that the movable stud 10 is connected to the driven means 12 by the first pin 12. The driven means 11 is further pivotally connected to the static latch 14 through a second pin 13. The static latch 14 may swing around the second pin 13 as a fulcrum. The static latch 14 is installed with an approximately cambered guide groove 18. The first pin 12 is matched with the guide groove 18 of the static latch 14 so that as the static latch 14 swings, it can be guided by the guide groove 18 and the first pin 12 to be moved statically. The guide groove 18 of the static latch 14 is protruded with a buckling portion 19 (see FIG. 2A). An ejecting spring (twisting spring) 20 is installed on the second pin 13 of the pivotal static latch 14 for ejecting the static latch 14 so as to protrude from the swinging of the movable stud 10. The auxiliary spring 15 is installed within the driven means 11. The front end of the auxiliary spring 15 is hooked and fixed to one fixing hook 21 of the driven means 11. The rear end of the auxiliary spring 15 is properly fixed. By aforesaid structure, an anti-theft latch of the present invention is formed.

The rear end of the driven means 11 protrudes from the movable stud 10. It can further match with a rear part 22 (see FIG. 2). The rear part 22 is received in a casing 23. The rear end of the driven means 11 protrudes out from the rear part 22. An extending spring 24 is installed between the rear part 22 and the movable stud 10 for ejecting the movable stud 10 to move outwards. The front end of the casing 23 is locked and fixed with an end plate 25. The end plate 25 is formed with a through hole 26 for being passed through by the movable stud 10. The rear end of the driven means 11 may pass through the rear end of the casing 23. The casing 23 and end plate 25 can be locked to a door, and the rear end of the driven means 11 serves to be connected to a knob and other control devices (not shown). It can be connected to the driven means 11 by the knob and other control devices. Therefore, the driven means 11 can be used to the movable stud 10 to retract.

Figure 5:
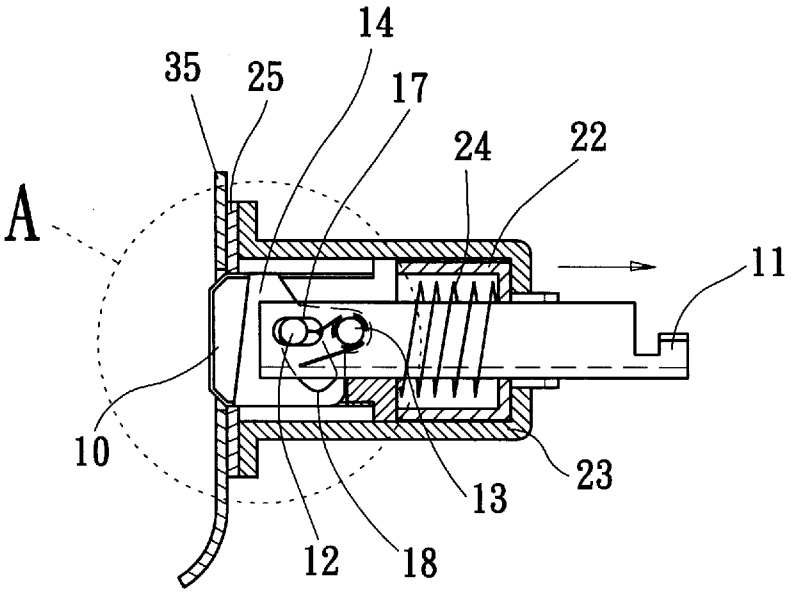
FIG. 5 is an operation schematic view of the first embodiment in the present invention.
Figure 5A:
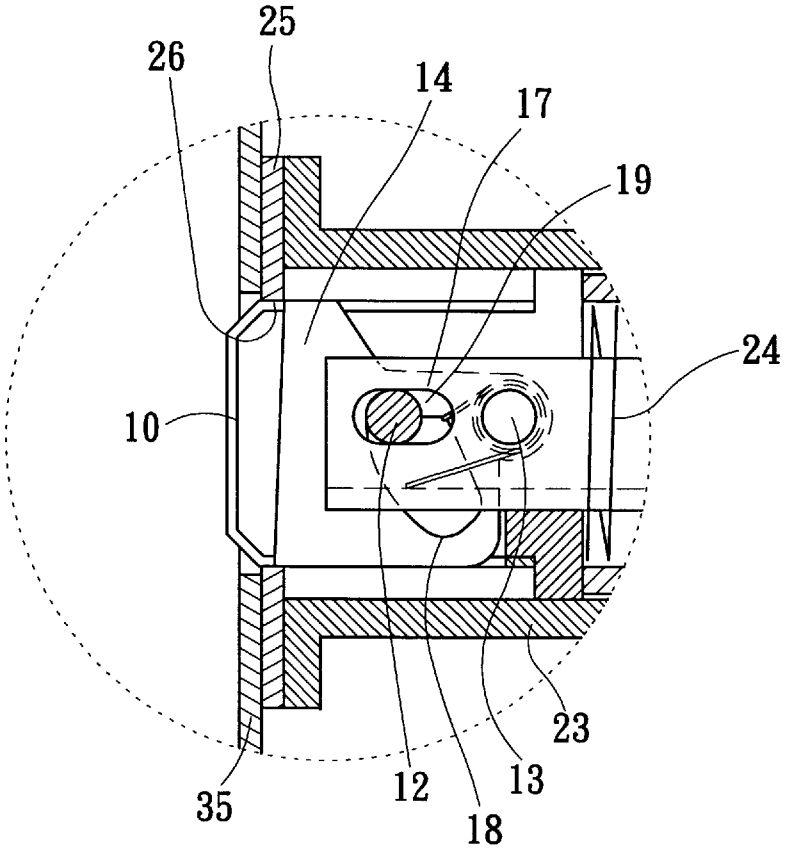
FIG. 5A is an enlarged detail of A in FIG. 5.
Figure 6:
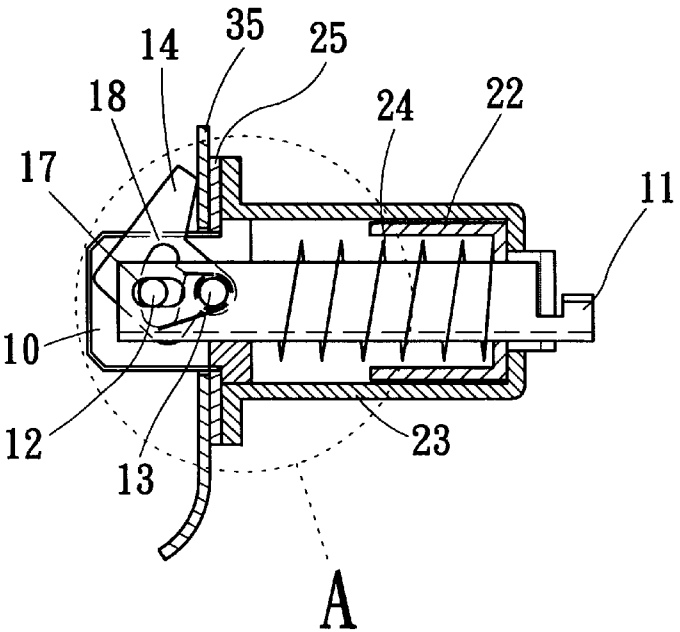
FIG. 6 is another operation cross sectional view of the first embodiment in the present invention.
Figure 6A:
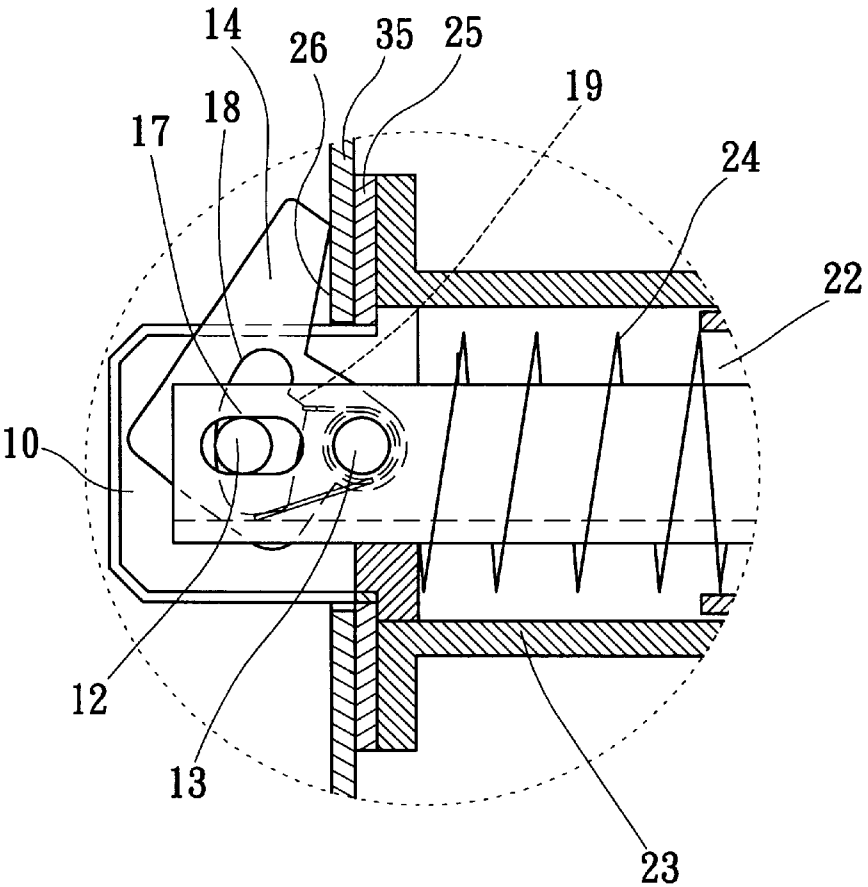
FIG. 6A is an enlarged detail of A in FIG. 6.
Figure 7:
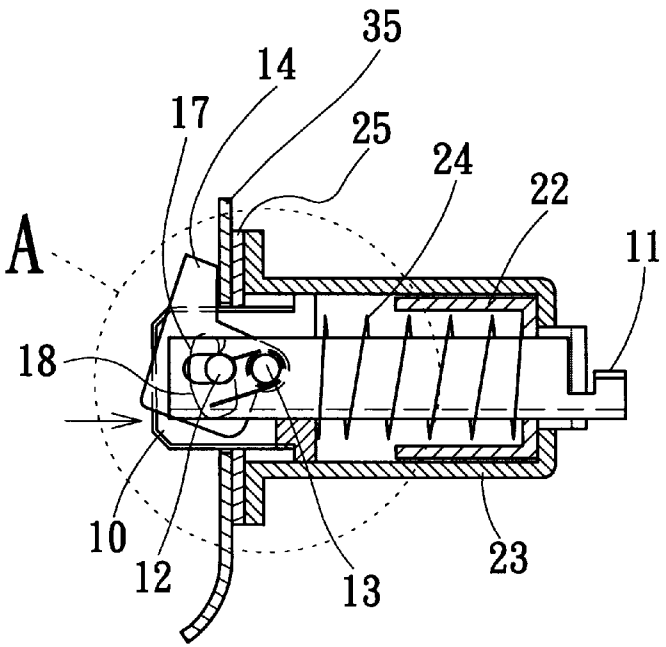
FIG. 7 is a yet operation schematic view of the first embodiment in the present invention.
Figure 7A:
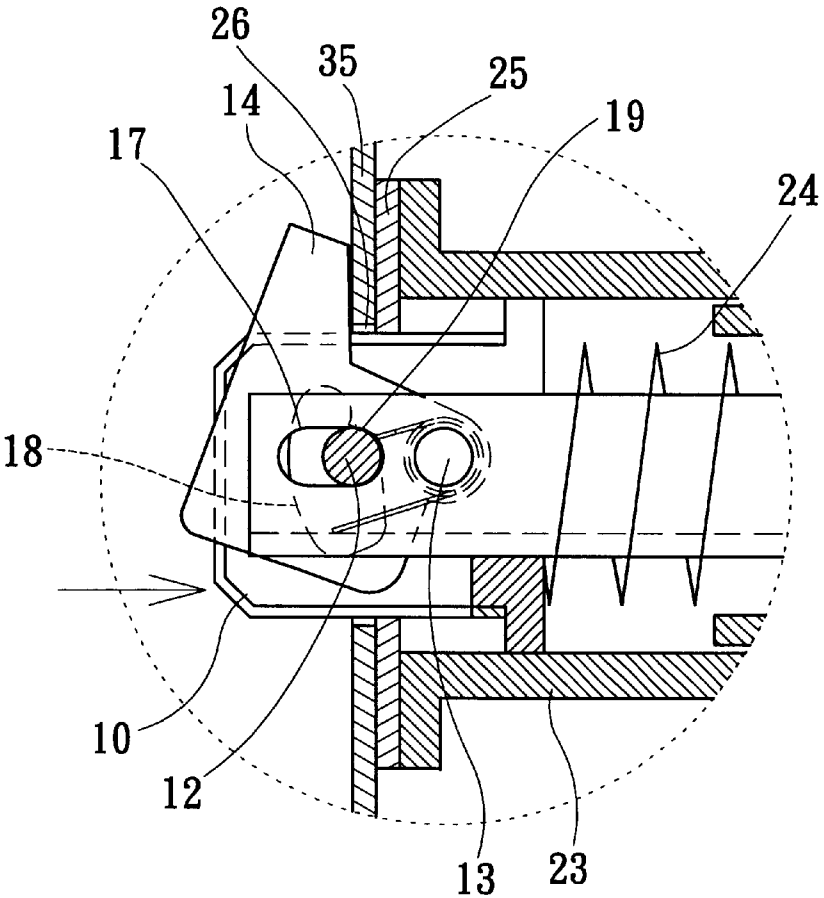
FIG. 7A is an enlarged detail of A in FIG. 7.

As shown in FIGS. 5 to 7, a different operational schematic view of the present invention is illustrated. When the movable stud 10 is desired to enter into a latch buckle 35. The static latch 14 is pressed by the latch buckle 35 and then retracts to the end plate 25 (see FIGS. 5 and 5A). When the movable stud 10 enters into the latch buckle 35 of a door frame, the movable stud 10 can be restored by an action of the extending spring, and thus, the movable stud 10 enters into the latch buckle 35 of the door frame. Thus, the static latch 14 protrudes from the movable stud 10 by the ejecting spring 20 (see FIGS. 6 and 6A). The protruding static latch 14 buckles the latch buckle 35 of a door frame as a hook. Thus, a thief can not unlock in force the movable stud 10 to move inwards. (FIGS. 7 and 7A). The static latch 14 is buckled and can not retracted backwards to the movable stud 10 for achieving an effect of statically latching. As a result, as the movable stud 10 is pressed by an outer force, the movable stud 10 will not retract to the casing 10 for achieving a preferred anti-theft effect.

In the present invention, the driven means 11 is installed with an auxiliary spring 15. The front end of the auxiliary spring 15 is fixed to the driven means 11. The rear end of the auxiliary spring 15 is fixed to the rear part 22. In normal condition, the auxiliary spring 15 may push the driven means 11 to move forwards. Meanwhile, the driven means 11 may drive the movable stud 10 to protrude out by the first pin 12 in order that in a normal condition, the movable stud 10 can be maintained in a protruding condition. When the driven means 22 move forwards, the first pin 12 on the movable stud 10 will slide backwards along the sliding groove 17 of the driven means 11 so that the first pin 12 ejects against the buckling portion 19 within the guide groove 18 of the static latch 14. As a result, the static latch 14 is buckled and thus can not retract within the movable stud 10 to achieve an effect of statically latching. Since in a normal condition, the static latch 14 protrudes from the latch buckle 35 of the door frame to achieve an effect of statically latching. Therefore, a thief has no possibility to unlock the movable stud 10 inwards and thus a preferred anti-theft is achieved.

Figure 8:
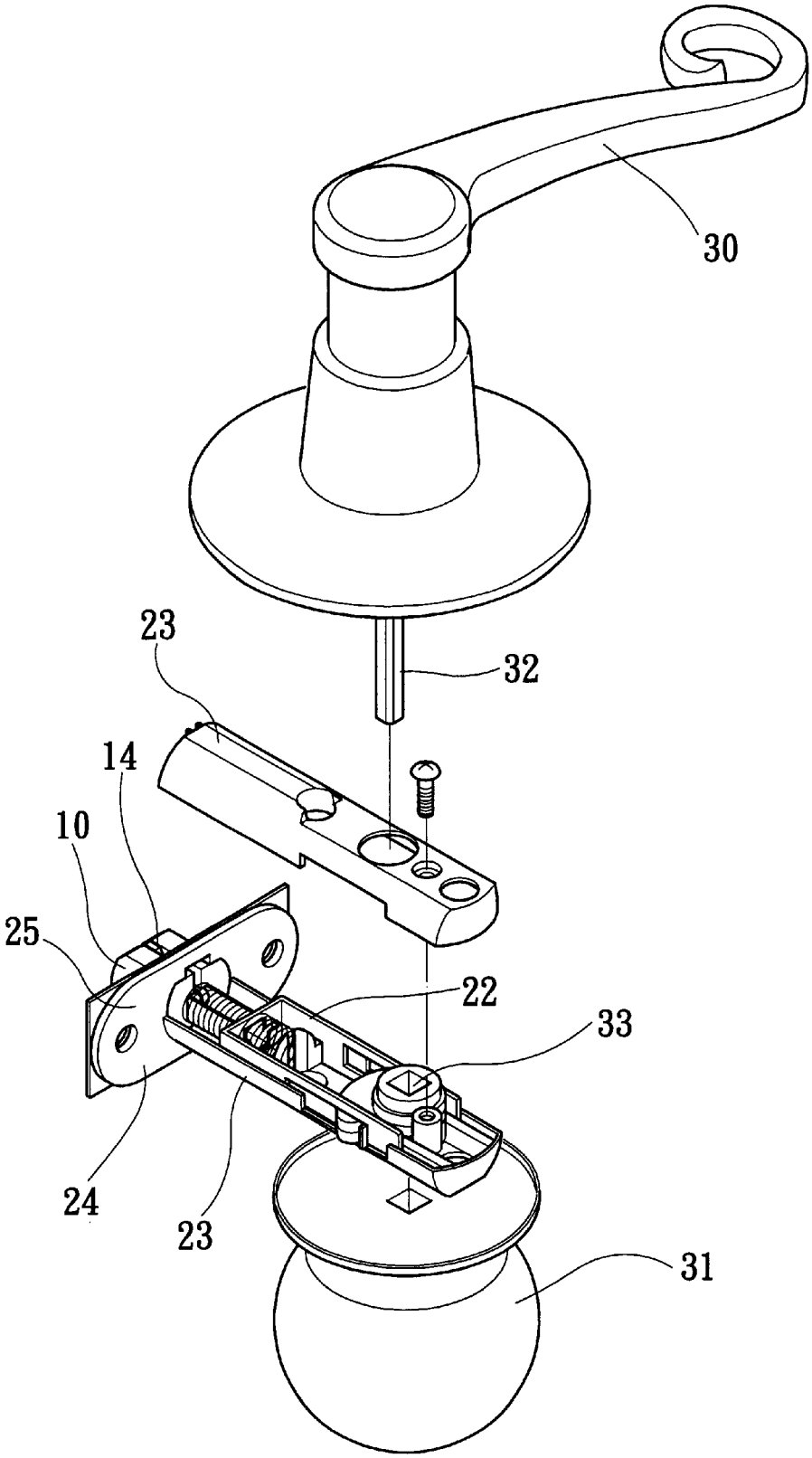
FIG. 8 is an assembled perspective view of the second embodiment in the present invention.
Figure 9:
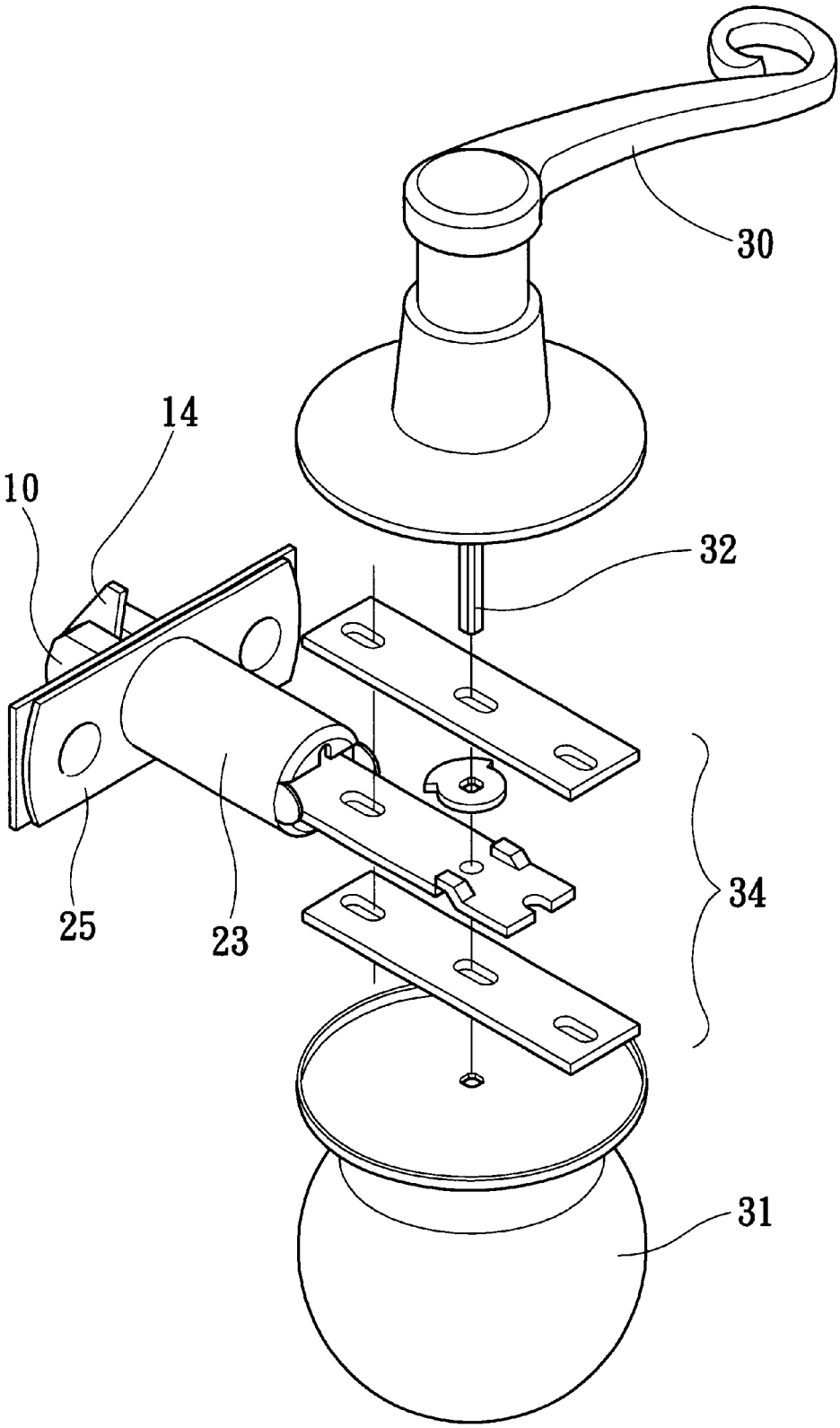
FIG. 9 is an assembled perspective view of the third embodiment in the present invention.
Figure 10:
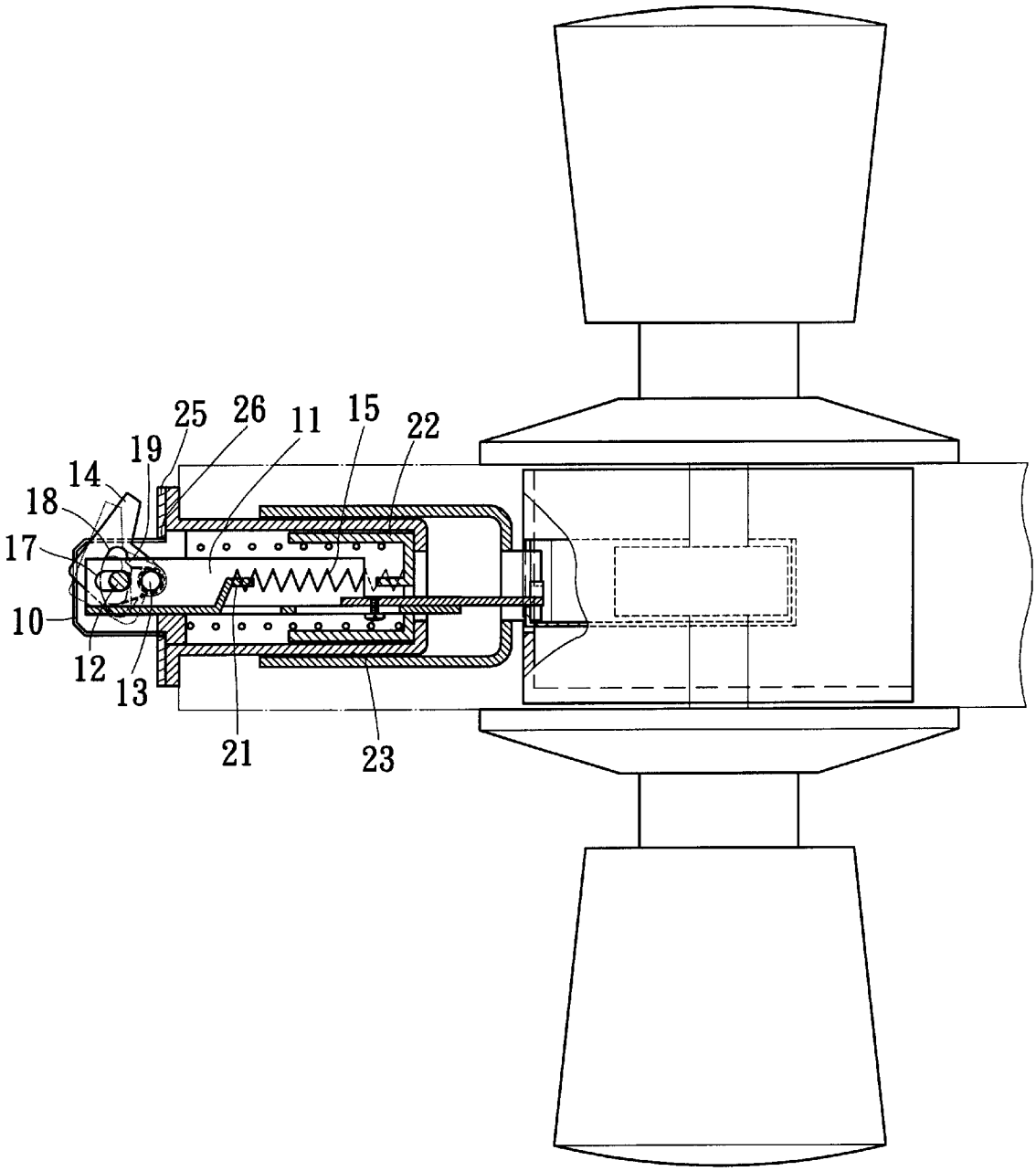
FIG. 10 is a plan cross sectional view of the fourth embodiment in the present invention.

As shown in FIG. 8, the rear part 22 and casing 23 in the present invention can be modified properly as desired. The present invention can be connected to knobs 30 and 31 and other control devices. The knobs 30 and 31 and other control devices serves to drive a spindle 32 for further drive the drive 11 to pull the movable stud 10 to retract. As shown in FIG. 9, a proper driven device 34 may be installed between the knobs 30 and 31 and the spindle 32. As shown in FIG. 10, the casing 23 of the present invention may be made as a telescopic device.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An anti-theft latch comprising a movable stud, a driven means, a pin, a static latch, and an auxiliary spring; the driven means capable of sliding forwards and backwards being installed in the movable stud; a pin hole being installed in the movable stud; a sliding groove being installed in the driven means; the pin being matched to the pin hole of the movable stud and the sliding groove of the driven means so that the movable stud and the driven means are connected as an integral body; the static latch being pivotally installed in the driven means; a guide groove being formed in the static latch; the pin being matched to the buckling portion; a further ejecting spring for ejecting the static latch to protrude from the movable stud; the auxiliary spring serving for pushing the driven means to move forwards; therefore, in a normal condition, the static latch achieves an effect of statically locking.

2. The anti-theft latch as claimed in claim 1, wherein the guide groove has a round cambered shape.

3. An anti-theft latch comprising a movable stud, a driven means, a pin, a static latch, and an auxiliary spring;

the driven means being capable of sliding forwards and backwards and being installed in the movable stud; a rear end of the driven means protruding out of the movable stud, which is further matched with a rear part, the rear part being received in a casing; a rear end of the driven means protruding out of the rear part; an extending spring being installed between the rear part and movable stud for ejecting the movable stud to protrude out; a front end of the casing being fixed to an end plate; a through hole being formed in the end plate; and a rear end of the driven means being connected to a control device;

a pin hole being installed in the movable stud; a sliding groove being installed in the driven means; the pin being matched to the pin hole of the movable stud and the sliding groove of the driven means so that the movable stud and the driven means are connected as an integral body;

the static latch being pivotally installed in the driven means; a guide groove being formed in the static latch; the pin being matched to the buckling portion; a further ejecting spring for ejecting the static latch to protrude from the movable stud; the auxiliary spring serving to push the driven means to move forwards;

whereby the static latch is biased to a statically locking configuration.

* * * * *